US006764390B2

(12) United States Patent
Holloway et al.

(10) Patent No.: US 6,764,390 B2
(45) Date of Patent: Jul. 20, 2004

(54) CENTRIFUGAL THROWING VANE

(75) Inventors: Katherine Holloway, Hogansville, GA (US); Dan Stoutamire, Douglasville, GA (US); James Simpkin, Claremont, NH (US)

(73) Assignee: International Surface Preparation Group, Inc., Golden, CO (US)

( * ) Notice: Subject to any disclaimer, the term of this patent is extended or adjusted under 35 U.S.C. 154(b) by 26 days.

(21) Appl. No.: 09/996,066

(22) Filed: Nov. 28, 2001

(65) Prior Publication Data

US 2003/0100249 A1 May 29, 2003

(Under 37 CFR 1.47)

(51) Int. Cl.[7] ..... B24C 5/06

(52) U.S. Cl. ..... 451/98; 451/95; 451/97

(58) Field of Search ..... 457/98, 95, 97

(56) References Cited

U.S. PATENT DOCUMENTS

| | | | |
|---|---|---|---|
| 1,462,786 | A | 7/1923 | Cleveland |
| 1,996,885 | A | 4/1935 | Schemmann et al. |
| 2,049,466 | A | 8/1936 | Minich |
| 2,077,635 | A | 4/1937 | Minich |
| 2,077,638 | A | 4/1937 | Minich |
| RE20,538 | E | 10/1937 | Minich |
| 2,108,211 | A | 2/1938 | Rosenberger et al. |
| 2,127,274 | A | 8/1938 | Steuart |
| 2,135,510 | A | 11/1938 | Hollingsworth |

(List continued on next page.)

FOREIGN PATENT DOCUMENTS

| | | |
|---|---|---|
| GB | 1003441 | 9/1965 |
| RU | 275782 | 7/1970 |

OTHER PUBLICATIONS

Wheelabrator, "IDEAS—Equipment Modernization Packages," product literature, (date unknown).

The Wheelabrator Corporation, "Ultrablast" Continuous Tumblast—A New Concept for Small Part Continuous In–Line Cleaning System, product literature, 1993.

The Wheelabrator Corporation, "6 Cubic Ft. Tumblast® TBR–6 Rubber Belt, TBS–6 Steel Belt," product literature ©1988 The Wheelabrator Corporation CC 7/94.

The Wheelabrator Corporation,"Wheelabrator Installation Services," Bulletin No. 13.08 product literature © 1990 The Wheelabrator Corporation CC2/90.

The Wheelabrator Corporation, "Wheelabrator has Pangborn® parts??" product literature, (date unknown).

The Wheelabrator Corporation, "Wheelabrator has Goff®parts??" product literature, (date unknown).

Wheelabrator, "Setting the Standards in Surface Preparation," B13.00A, product literature © 1988 The Wheelabrator Corporation CC 2/94.

(List continued on next page.)

*Primary Examiner*—George Nguyen
(74) *Attorney, Agent, or Firm*—Lowrie, Lando & Anastasi, LLP

(57) ABSTRACT

An improved vane for use with a centrifugal throwing apparatus. The vane has a convex leading surface and flared edges to provide a consistent, broad blast pattern and improved vane wear characteristics. In one embodiment, the vane includes a pickup end, a discharge end opposed to the pickup end, and a leading surface connecting the pickup end to the discharge end. A portion of the leading surface is convex in cross section. Two opposed longitudinal edges define the leading surface, with at least one of the edges being outwardly flared. In an alternative embodiment, the vane includes a longitudinal raised rail formed near one edge of the leading surface, the rail being outwardly flared.

24 Claims, 3 Drawing Sheets

U.S. PATENT DOCUMENTS

| | | | | | |
|---|---|---|---|---|---|
| 2,204,618 | A | | 6/1940 | Peik | |
| 2,301,508 | A | | 11/1942 | Blount | |
| 2,493,215 | A | | 1/1950 | Barnes | |
| 2,590,573 | A | | 3/1952 | Rinia | |
| 2,590,576 | A | | 3/1952 | Rosenberger et al. | |
| 2,789,804 | A | | 4/1957 | Toulmin, Jr. | |
| 3,368,308 | A | | 2/1968 | Physioc, III | |
| 3,436,867 | A | | 4/1969 | Fuerst | |
| 3,678,629 | A | | 7/1972 | Leliaert | |
| 3,694,963 | A | | 10/1972 | Leliaert | |
| 3,785,105 | A | | 1/1974 | Freeman | |
| 3,872,624 | A | | 3/1975 | Ramaswamy | |
| 3,936,979 | A | | 2/1976 | Fuerst | |
| 4,207,712 | A | | 6/1980 | Toedtli | |
| 4,244,150 | A | | 1/1981 | Goff | |
| 4,249,350 | A | | 2/1981 | Goff | |
| 4,329,819 | A | | 5/1982 | May | |
| 4,333,278 | A | | 6/1982 | Schulte et al. | |
| 4,402,163 | A | | 9/1983 | Carpenter et al. | |
| 4,473,972 | A | | 10/1984 | Leliaert | |
| 4,480,413 | A | | 11/1984 | Schulte et al. | |
| 4,509,300 | A | | 4/1985 | Carpenter et al. | |
| 4,521,996 | A | | 6/1985 | Grund et al. | |
| 4,646,483 | A | | 3/1987 | Mangan | |
| 4,759,156 | A | | 7/1988 | Baumgart | |
| 4,941,296 | A | | 7/1990 | Carpenter | |
| 4,941,297 | A | | 7/1990 | Carpenter | |
| 5,081,801 | A | | 1/1992 | Fylak | |
| 5,205,085 | A | | 4/1993 | Urakami | |
| 5,209,024 | A | | 5/1993 | Carpenter et al. | |
| 5,472,369 | A | | 12/1995 | Foster et al. | |
| 5,476,412 | A | * | 12/1995 | Stoltz | 451/75 |
| 5,688,162 | A | | 11/1997 | Williams | |
| 5,702,289 | A | | 12/1997 | Champaigne | |
| 5,846,124 | A | * | 12/1998 | Rokutanda et al. | 451/95 |
| 6,126,516 | A | * | 10/2000 | Barrier et al. | 451/38 |
| 6,447,378 | B1 | * | 9/2002 | Hoff | 451/95 |

OTHER PUBLICATIONS

The Wheelabrator Corporation, "Surface Preparation for Plate, Structural Steel & Pipe," Bulletin 60.00 product literature ©1990 The Wheelabrator Corporation CC3/94.

The Wheelabrator Corporation, "The Wheelabrator Bi–Directional Wheel," product literature © 1993 The Wheelabrator Corporation CC4/96.

* cited by examiner

CENTRIFUGAL THROWING VANE

BACKGROUND OF THE INVENTION

1. Field of the Invention

The present invention relates to a vane for a centrifugal throwing wheel and, more particularly, to a vane for a centrifugal throwing wheel which exhibits improved shot distribution and wear characteristics.

2. Description of the Related Art

Centrifugal throwing wheels and vanes (blades) associated with them can be used to propel abrasive at high speed onto a work surface that is to be abraded, prepared or otherwise surface treated. Typically, a number of blades are radially attached to the throwing wheel and are configured such that abrasive material can be fed onto the heel of the blade and then accelerated along the length of the blade by the angular velocity of the wheel. The abrasive material leaves the outermost end of the vane and contacts the work surface. Depending on the specific application, a wide variety of abrasives may be used including steel shot, steel grit, wire, and crushed shells.

Often, it may be desirable to control the shot pattern that is obtained with a blasting apparatus. For different applications, the optimum shot pattern may be either tight and concentrated or broad and dispersed. When one of the goals of the shot blasting procedure is to quickly and evenly abrade a work surface, it may be desirable for the shot to cover as broad an area as possible, but the shot pattern should also be consistent to reduce uneven abrasion. Several different types of blade designs have been used in an effort to achieve this goal. For example, a vane with slightly flaring, rather than straight, sidewalls is disclosed by Carpenter in U.S. Pat. No. 4,941,297. This feature allows any particles that happen to be directed laterally to spread out rather than be contained by the channel provided by a vane with essentially parallel edges. Another approach was disclosed by Fuerst in U.S. Pat. No. 3,436,867, which discloses a vane having a leading surface that is convex in the direction of wheel rotation and parallel side walls. This convex shape serves to accelerate the particles laterally.

Another persistent, art-recognized problem is the uneven wearing of throwing vanes. As shot is accelerated down the surface of a vane, it tends to take the shortest path to the tip, absent any forces other than that supplied by the angular velocity of the wheel. As a result, conventional vanes exhibit excessive wear along their centerline and, consequently, they must be replaced more often than would be required if the shot wore the vanes evenly across the entire leading surface. Alternatively, vanes such as those described by Fuerst that distribute abrasive laterally tend to wear most quickly along the side walls where the majority of abrasive is concentrated. As the cost of abrasive material and replacement vanes for centrifugal throwing wheels has continued to rise, the surface treatment industry has developed a long felt, yet unsolved need for a centrifugal throwing vane having improved shot distribution and wear characteristics.

SUMMARY OF THE INVENTION

Accordingly, the present invention is directed to a vane for a centrifugal throwing apparatus. The vane has a convex leading surface and flared edges to provide a consistent, broad blast pattern and improved wear characteristics.

In one embodiment, the vane includes a pickup end, a discharge end opposed to the pickup end, and a leading surface connecting the pickup end to the discharge end. A portion of the leading surface is convex in cross section. Two opposed longitudinal edges define the leading surface, with at least one of the edges being outwardly flared.

In various alternative embodiments, both of the two opposed longitudinal edges may be outwardly flared. The leading surface may be convex from a point on the leading surface where laminar flow begins. The radius of convexity may increase between the pickup end and the discharge end of the vane. At least one of the edges may be flared outwardly at an increasing rate from the start of the flare to the discharge end of the vane.

In another alternative embodiment, the vane includes a longitudinal raised rail formed near one edge of the leading surface, the rail being outwardly flared. A portion of the leading surface is convex in cross section. The radius of convexity may increase between the pickup end and the discharge end of the vane. Alternatively, the vane may include a raised rail on each side of the leading surface, both of the rails being outwardly flared. At least one of the rails may be flared outwardly at an increasing rate from the start of the flare to the discharge end of the vane.

BRIEF DESCRIPTION OF THE DRAWINGS

Other objects and features of the present invention will become apparent from the detailed description of preferred embodiments when read in light of the attached drawings. It is to be understood that these drawings are for illustration purposes only and are not intended to define the limits of the present invention, wherein.

DETAILED DESCRIPTION OF PREFERRED EMBODIMENTS

The present invention is directed to a vane for a centrifugal throwing wheel. The vane has a leading surface, a portion of which is convex in cross section, and also has at least one edge or rail that is flared outwardly. The unique configuration of the vane of the present invention allows for a consistently broad blast pattern and improved vane wear characteristics.

Although the present invention will be described more fully in the surface treatment context, it is contemplated that the invention can find utility in any type of application where uniform spreading and distribution of material is desirable.

Vanes (or blades) used in conjunction with a rotating wheel for the purpose of throwing abrasive are well known in the art. The size, shape, and composition of these vanes may be varied to provide different properties. At times, it may be desirable to obtain a wide broadcast pattern of abrasive material from a given throwing apparatus. It is also desirable to reduce vane wear so that vanes require less frequent replacement.

Typically, throwing vanes are sized to fit specific throwing wheels and are limited in size and weight by the wheel with which they are used. Although the vane of the present invention can be used with any size wheel and be made in a variety of sizes, it is contemplated that the vane may be used with a standard 2.5 inch wheel. Such a vane is preferably about 10 cm (4 inches) wide, about 21 cm (8 inches) long, and about 2.5 cm (1 inch) thick in the central portion of the vane. The vane of the present invention can be formed of conventional materials using conventional methods known to those skilled in the art.

Figure 1:
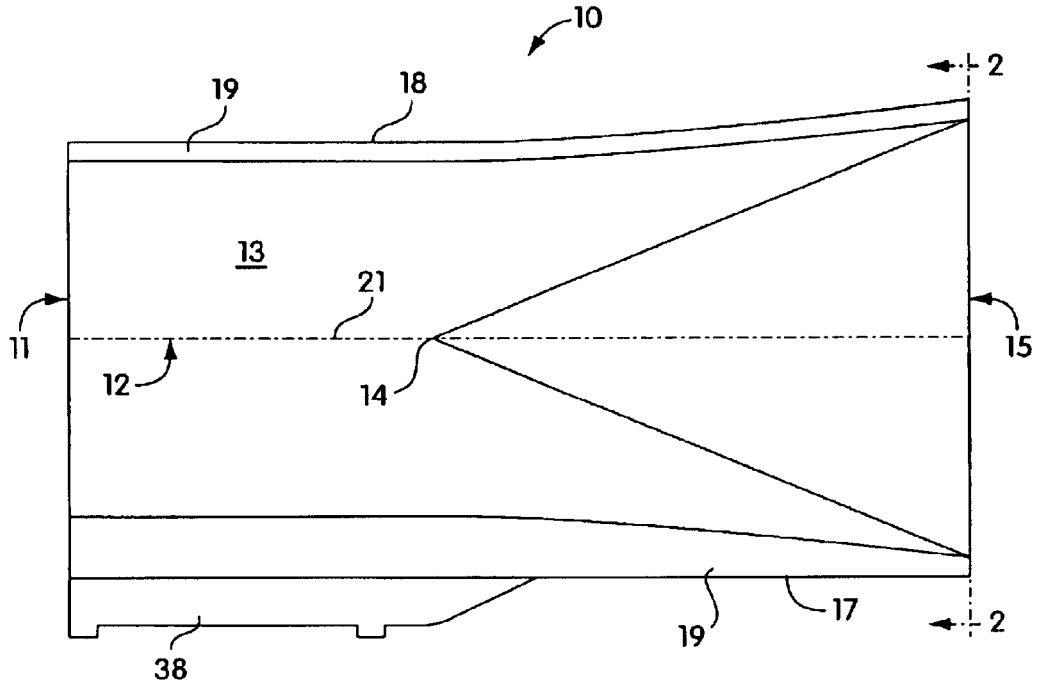
FIG. 1 is a top plan view of an aspect of an embodiment of the present invention.

As shown in FIG. 1, one embodiment of the present invention is directed to a throwing vane 10 having a base end 11 where it is affixed to a throwing wheel and a discharge end 15 where the abrasive material exits the vane during operation. Base end 11 has a pickup point 12 that is usually centered over the opening of a control cage (not shown) that locates abrasive material coming out of an impeller on the wheel.

Figure 2:
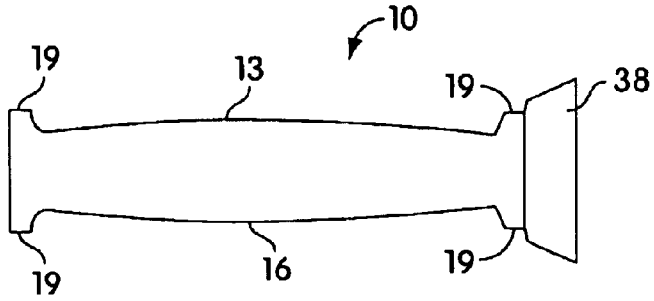
FIG. 2 is a cross-sectional end view taken along line 2—2 of FIG. 1.
Figure 3:
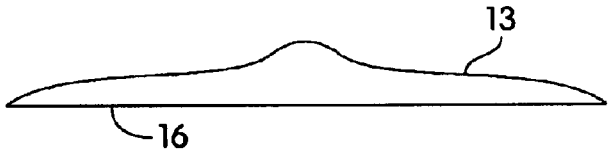
FIG. 3 is a cross-sectional view of an aspect of an alternative embodiment of the present invention.
Figure 4:
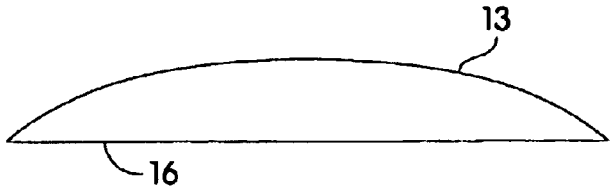
FIG. 4 is a cross-sectional view of an aspect of an alternative embodiment of the present invention.
Figure 6:
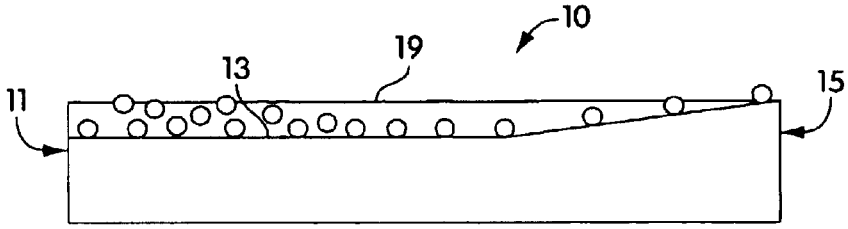
FIG. 6 is a cross-sectional side view taken along line 6—6 of FIG. 1.

Vane 10 has a leading surface 13 and an opposing surface 16 (FIG. 2); at least a portion of leading surface 13 is convex in cross section. The shape of the convex surface may be, for example, an arc or a derivative thereof, where the rate of curvature increases near a centerline 21 and is less near the edges (see FIG. 3) or, alternatively, where the rate of curvature is less near centerline 21 and increases more sharply near the edges of the vane (see FIG. 4). It is also contemplated that the vane may include a series of convexities across the surface to provide for unique blast patterns. As shown in FIG. 6, to produce a consistent broadcast pattern, it is preferable that the convexity start at a point on the vane where the stream of abrasive material that is fed onto the blade during operation has obtained substantially laminar flow (i.e., the "substantially laminar flow point"). As used herein, the term "substantially laminar flow point" refers to a location on leading surface 13 where substantially all of the abrasive material introduced onto the vane has stopped bouncing. The location of the substantially laminar flow point depends on the type of abrasive material used and is typically located near a longitudinal midpoint 14 of vane 10. It is preferable that the convexity be increased gradually from about midpoint 14 of vane 10 to discharge end 15. The increase in the convexity may be constant or variable. To obtain a wide yet uniform blast pattern, the convex surface may be an arc, and in one embodiment the radius of the convex surface preferably increases gradually from about 0 mm at about midpoint 14 of vane 10 to between about 1.5 mm (1/16 inch) and about 15 mm (3/5 inch) at discharge end 15. More preferably, the radius increases from about 0 mm at about midpoint 14 to between about 5 mm (1/5 inch) and about 15 mm (3/5 inch) at discharge end 15. Most preferably, the radius increases from about 0 mm at about midpoint 14 of vane 10 to about 7 mm (1/4 inch) at discharge end 15.

To further increase the consistency of the broadcast pattern, the leading surface of vane 10 can be relatively planar along its longitudinal axis or even concave towards the base end. Vanes that are curved in the direction of travel are described in U.S. Pat. No. 3,872,624, which is hereby incorporated by reference herein in its entirety.

Opposing surface 16 of vane 10 may also have a convex surface and the amount of curvature and pattern on each surface may either be identical or varied. This allows the vane to be turned over to introduce a different leading surface that effectively doubles the useful life of the vane. By having a different amount of convexity on either side of the vane, the same vane may be used to produce two different blast patterns.

Vane 10 has two longitudinal edges 17, 18 that extend from base end 11 to discharge end 15. At least one of the edges (or a raised rail 19 that runs for a portion of the length of the vane) is flared outwardly from base end 11 to discharge end 15. The flare may extend for the entire length of the vane or may extend for only a portion of the vane's length.

Either one or both edges (or rails) of vane 10 may be flared. The flare may be formed in a specific angle and extend in a straight line or it may be curved over the length of the vane. The rate of curvature may be constant or may vary over the length of the vane. Both edges (or rails) of the vane may be flared at similar or different angles. Preferably, there is a flare on each side, and in one embodiment the flare starts at a point along the vane that is within about 7 cm (3 inches) of the pickup end of the vane. Most preferably, each flare extends outwardly about 12 mm (1/2 inch) from the start of the flare to the end. The flare angle and rate of curvature are preferably selected in combination with the aforementioned radius of convexity such that the section of the leading surface over which the abrasive travels is about 24 mm (9/10 inch) wider at discharge end 15 than it is at the point where the convexity begins.

To help contain the abrasive in the desired pattern, one or more flared rails 19 may be formed on leading surface 13. Preferably, rails 19 are raised, for example, about 5 mm (1/5 inch) and run the entire length of leading surface 13. It is not necessary for rails 19 to parallel either edge and the amount of effective flare on one of the surfaces may be narrower than that on the opposing surface by forming the rails of the vane well inside of the actual outside borders of the leading surface.

Different vanes exhibiting different amounts of convexity and flare may be used on the same wheel to produce a variety of blast patterns. By using vanes that have different levels of convexity or flare on the opposed surfaces, the number of blast patterns that can be produced from a set of vanes is limitless.

Figure 5:
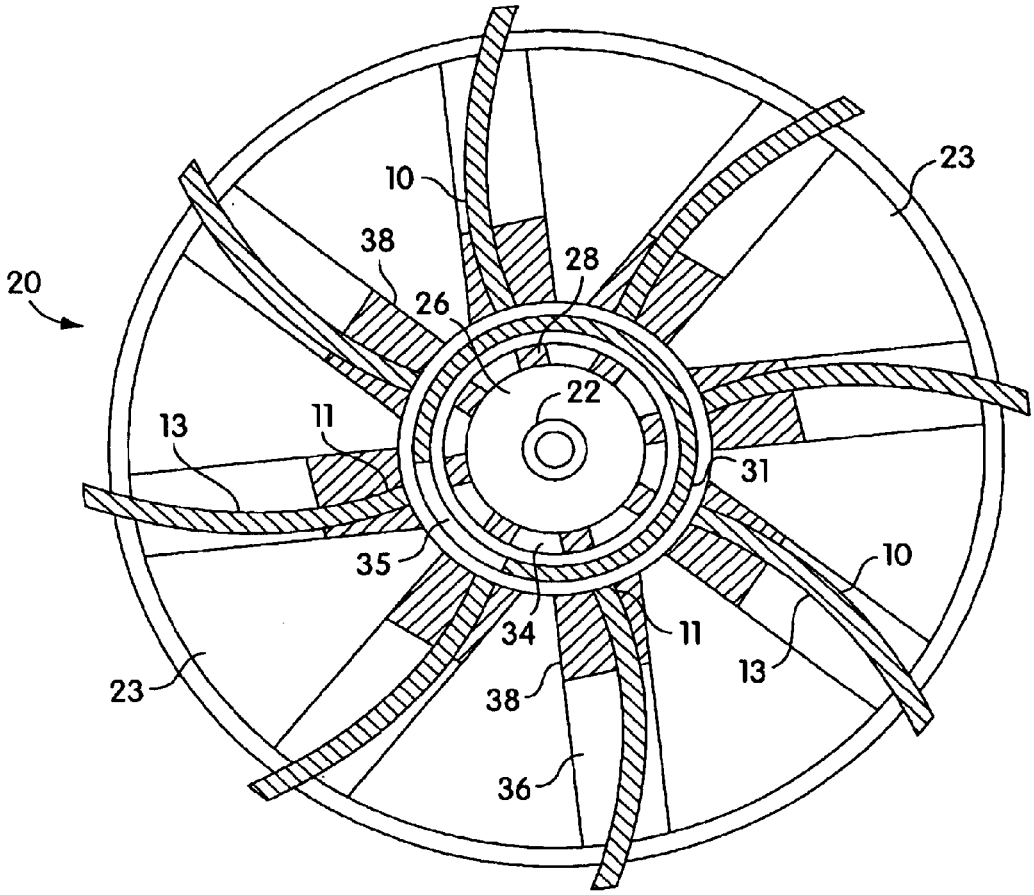
FIG. 5 is a cut-away view of an aspect of an embodiment of the present invention.

As noted, the vane of the present invention can be used in conjunction with a centrifugal throwing wheel. As shown in FIG. 5, a centrifugal throwing wheel 20 may include a central hub or rotor 22 to which is affixed a runnerhead 23 having a common axis therewith. A plurality of curved vanes 10 can be perpendicularly mounted on the face of runner head 23 and extend generally radially from the axis of rotation of rotor 22. Base end 11 of each vane 10 may be spaced a distance from the axis of rotation for receiving abrasive material from an impeller 28.

Impeller 28 may be rotatably disposed on hub 22 between base ends 11 of vanes 10 for feeding the abrasive material as received from a spout (not shown) in communication with an interior portion 26 of impeller 28 to base end 11 of vanes 10 as described above. Impeller 28 may include an open ended outer case 31 having a discharge opening 35 for depositing abrasive material on vanes 10. Impeller 28 may be provided with openings 34 for discharging abrasive material received from the spout outwardly from interior portion 26 and through discharge opening 35 upon rotation of wheel 20. In this manner, abrasive material can be fed to base end 11 of vanes 10 as the vanes rotate past opening 35. The abrasive material can then be moved along leading surface 13 of vanes 10 from base end 11 to discharge end 15 as described above.

The face of runnerhead 23 may have formed therein a plurality of slots 36 of suitable dovetail or other undercut configuration at an angle to a radial line. Each slot 36 may be adapted to removably receive a base portion 38 of a vane with the base portion being inserted into the slot and retained therein by a suitable locking pin or the like (not shown).

The present invention will be further illustrated by the following examples, which are intended exclusively to be illustrative in nature and are not to be construed as limiting the scope of the invention.

EXAMPLE 1

To determine the effectiveness of the present invention, a vane with a convexity of zero at the midpoint increasing to 6 mm (¼ inch) at the discharge end was compared to a traditional flat vane with no convexity. Both the traditional vane and the vane according to the invention were about 21 cm (8.3 inches) long and about 10 cm (4.5 inches) wide. In each case, the vanes were tested on a standard 6.5 cm (2.5 inch) wheel using steel shot and the width of the blast pattern or "hot spot" was measured at a distance of 30.5 inches. The width of the hot spot with the conventional vane was 4 inches while the width of the hot spot for the convex blade with a 6 mm radius was 8 inches. In both cases, examination revealed that the shot was equally distributed across the entire width of the hot spot. It was apparent, therefore, that the embodiment of the present invention tested was superior to the conventional flat vane in producing a consistent, broad blast pattern.

It will be understood that each of the elements described herein, or two or more together, may be modified or may also find utility in other applications differing from those described above. For example, conventional vanes may be employed in combination with the presently disclosed vanes as dictated by specific requirements. Also, it is contemplated that the present invention, as described herein, can be used as part of a larger surface preparation system. While the invention has been illustrated and described as embodied in a centrifugal throwing vane, it is not intended to be limited to the details shown, since various modifications and substitutions may be made without departing in any way from the spirit of the present invention as defined by the following claims.

What is claimed is:

1. A vane for a centrifugal throwing wheel, said vane comprising:

a pickup end;

a discharge end opposed to the pickup end;

a leading surface connecting the pickup end to the discharge end, a portion of the leading surface being convex in cross section, wherein the leading surface is convex from a substantially laminar flow point; and two opposed longitudinal edges defining the leading surface, at least one of the edges being outwardly flared.

2. The vane of claim 1, wherein both of the two opposed longitudinal edges are outwardly flared.

3. The vane of claim 1, wherein said at least one of the edges is flared outwardly starting from a point proximate the pickup end.

4. The vane of claim 1, having a radius of convexity that increases from about 0 mm near the pickup end to between about 5 mm and about 15 mm at the discharge end of the vane.

5. The vane of claim 4, wherein the radius of convexity increases from about 0 mm at a longitudinal midpoint of the vane to about 7 mm at the discharge end of the vane.

6. The vane of claim 1, wherein said at least one of the edges is flared outwardly at an increasing rate from the start of the flare to the discharge end of the vane.

7. The vane of claim 1, wherein the leading surface has a width of between about 5 cm and about 15 cm.

8. The vane of claim 7, wherein the width of the leading surface is about 10 cm.

9. The vane of claim 1, wherein said at least one of the edges is flared outwardly by a distance of between about 5 mm and about 15 mm from the start of the flare to the discharge end of the vane.

10. The vane of claim 9, wherein said at least one of the edges is flared outwardly by a distance of about 11 mm from the start of the flare to the discharge end of the vane.

11. The vane of claim 10, wherein the leading surface has a width of about 10 cm.

12. A vane for a centrifugal throwing wheel, said vane comprising:

a pickup end;

a discharge end opposed to the pickup end;

a leading surface connecting the pickup end to the discharge end, a portion of the leading surface being convex in cross section, wherein the leading surface is convex from a substantially laminar flow point;

two opposed longitudinal edges defining the leading surface; and a longitudinal raised rail formed near one edge of the leading surface, the rail being outwardly flared.

13. The vane of claim 12, having a raised rail on each side of the leading surface, each of the rails being outwardly flared.

14. The vane of claim 12, wherein the rail is flared outwardly from a point proximate the pickup end.

15. The vane of claim 12, having a radius of convexity that increases from about 0 mm near the pickup end to between about 5 mm and about 15 mm at the discharge end of the vane.

16. The vane of claim 15, wherein the radius of convexity increases from about 0 mm at a longitudinal midpoint of the vane to about 7 mm at the discharge end of the vane.

17. The vane of claim 12, wherein the rail is curved.

18. The vane of claim 12, wherein the rail is flared outwardly at an increasing rate from the start of the flare to the discharge end of the vane.

19. The vane of claim 12, wherein the leading surface has a width of between about 5 cm and about 15 cm.

20. The vane of claim 19, wherein the width of the leading surface is about 10 cm.

21. The vane of claim 12, wherein the rail is flared outwardly by a distance of between about 5 mm and about 15 mm from the start of the flare to the discharge end of the vane.

22. The vane of claim 21, wherein the rail is flared outwardly by a distance of about 11 mm from the start of the flare to the discharge end of the vane.

23. The vane of claim 22, wherein the leading surface has a width of about 10 cm.

24. A vane for a centrifugal throwing wheel, said vane comprising:

a pickup end;

a discharge end opposed to the pickup end;

a leading surface about 10 cm wide and about 21 cm long connecting the pickup end to the discharge end, the leading surface being convex in cross section with the convexity starting at a point about midway between the pickup end and the discharge end of the vane and continuing to the discharge end of the vane, the leading surface having a radius of convexity of about 7 mm proximate the discharge end of the vane;

two opposed longitudinal edges defining the leading surface; and a raised rail running inside of each edge, each rail being outwardly flared a distance of about 11 mm from the start of the flare to the discharge end of the vane.

* * * * *